US005406024A

United States Patent [19]

Shioda

[11] Patent Number: 5,406,024

[45] Date of Patent: Apr. 11, 1995

[54] ELECTRONIC SOUND GENERATING APPARATUS USING ARBITRARY BAR CODE

[75] Inventor: Kazuaki Shioda, Hamamatsu, Japan

[73] Assignee: Kabushiki Kaisha Kawai Gakki Seisakusho, Japan

[21] Appl. No.: 36,042

[22] Filed: Mar. 23, 1993

[30] Foreign Application Priority Data

Mar. 27, 1992 [JP] Japan ..... 4-071518
Mar. 27, 1992 [JP] Japan ..... 4-071519
Mar. 27, 1992 [JP] Japan ..... 4-071520

[51] Int. Cl.[6] ..... G10H 1/057; G10H 1/06; G10H 1/42; G10H 1/46

[52] U.S. Cl. ..... 84/622; 84/627; 84/633; 84/635; 84/DIG. 12

[58] Field of Search ..... 84/609–620, 84/622–633, 649–669, DIG. 12, DIG. 22

[56] References Cited

U.S. PATENT DOCUMENTS 4,261,241 4/1981 Gould et al. ..... 84/617 X
4,422,361 12/1983 Ishii et al. .
4,437,378 3/1984 Ishida et al. .
4,464,966 8/1984 Ishida ..... 84/DIG. 12
4,876,938 10/1989 Shinohara ..... 84/611
5,231,488 7/1993 Mohrbacher et al. ..... 84/653

FOREIGN PATENT DOCUMENTS 0343958 11/1989 European Pat. Off. .

*Primary Examiner*—Stanley J. Witkowski
*Attorney, Agent, or Firm*—Davis, Bujold & Streck

[57] ABSTRACT

An electronic sound generating apparatus which generates sound or recreates music performance according to the data included in a bar code. The apparatus includes a scanner to scan a bar code. Attributes of sound or music are assigned to parameters of control data for synthesizing sound or recreating music performance. Each of the parameters is given a specific value by the data included in a bar code scanned by the scanner. The resulted sound or music performance is provided with random, accidental, and unexpected characteristics, and an operator need not perform inputting operation to vary sound or music performance.

16 Claims, 9 Drawing Sheets

RHYTHM PATTERN OF BASS DRUM

ELECTRONIC SOUND GENERATING APPARATUS USING ARBITRARY BAR CODE

BACKGROUND OF THE INVENTION

This invention relates to an electronic sound generating apparatus which determines control data of sound or of music performance according to data included in bar codes, thereby synthesizing sound or recreating music performance varied according to the bar code data.

In a conventional electronic organ and electronic piano, selection keys are provided to select a desired tone or type of sound timbre, rhythm, or other music elements from among a predetermined number of registered options.

A conventional synthesizer and a rhythm machine have numerous input parts or means to select various types of timbre and rhythm pattern. A desired type of timbre or rhythm pattern is obtained by selecting it at the input part.

On the other hand, in a conventional automatic piano, a number of floppy discs are available to recreate music performed by wide range of pianists. Selection of the floppy discs itself is, by definition, selection of the performance to be recreated.

Such an electronic organ, electronic piano, synthesizer, rhythm machine, and automatic piano, however, do not allow operators to enjoy variance in timbre, rhythm, or performance beyond what is already registered or recorded. Moreover, most casual users have shied away from the labor of inputting a great number of values for parameters of the sound or music.

SUMMARY OF THE INVENTION

Wherefore, an object of this invention is to provide an electronic sound generating apparatus which selects sound attribute control data for a sound or music performance according to bar code data, thereby permitting variances in characteristics or attributes of sound and music. Since control data in synthesizing sound or music is determined simply by scanning an arbitrary bar code, an operator is free from the laborious and complicated operation of inputting a great number of parameter data. Moreover, the resulted sound or music is accidental and unexpected, and therefore can be very entertaining.

In order to attain the stated object, the apparatus of the present invention comprises memory means for storing sound attribute control data with respect to each digit of a bar code, scanning means capable of scanning a bar code, selection means for selecting, according to the bar code data scanned by the scanning means, sound attribute control data with respect to the digits of a bar code from those stored in the memory means, and sound generating means for generating sound or recreating music performance according to the sound attribute control data selected by the selection means.

DETAILED DESCRIPTION OF THE PREFERRED EMBODIMENT

Figure 1:
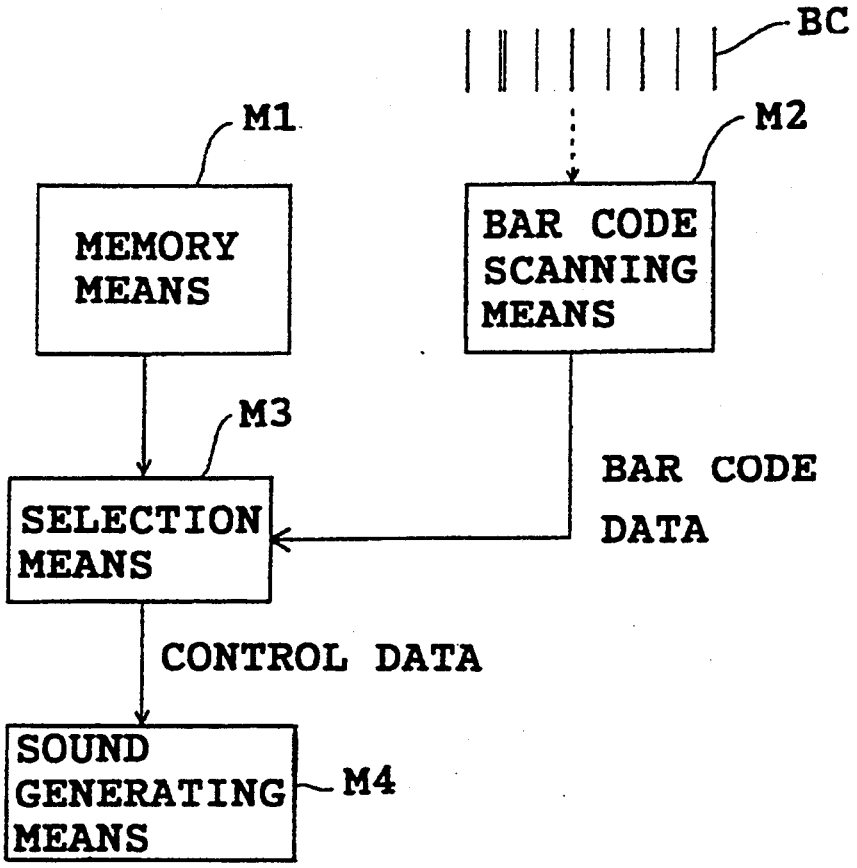
FIG. 1 is a block diagram schematically showing the structure of an electronic sound generating apparatus of first through fourth embodiments according to the present invention.

Four embodiments of the present bar code player are explained hereunder although it is understood that other embodiments are within the scope of the present invention.

Similar components have been given similar reference numerals throughout the embodiments.

In the four embodiments, the exemplary bar codes BC, shown in FIGS. 1, 5, 6A, 10, and 11 are JAN codes (Japanese Article Number code: one type of bar code) and are utilized to provide data according to which sound is generated or music is recreated. Generally, there are two types of JAN code, i.e. one is so-called standard type with thirteen digits, and the other is smaller one with eight digits. As shown in the figure, the standard type of JAN code with thirteen digits is adopted.

All of the standard type of JAN code on the commodities produced in Japan have the figures "49" in common at the leftmost two digits. Therefore, the leftmost two digits are ignored in allocating parameters of control data in order to avoid uniformity in characteristics of sound or music performance.

[EMBODIMENT 1]

Figure 2:
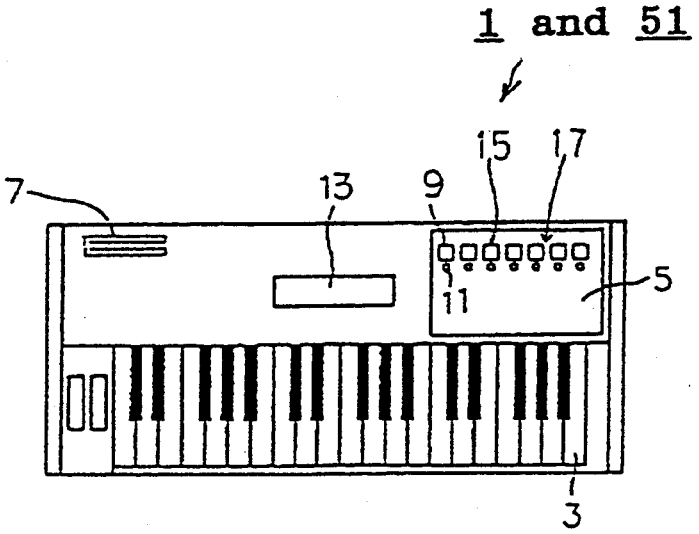
FIG. 2 is a top plan view showing a keyboard and other related parts on a panel of a synthesizer and an electronic organ of the first and the second embodiments.

As shown schematically in FIG. 2, a synthesizer 1 of a first embodiment includes a key board 3, a control panel 5, and a bar code scanner 7. The control panel 5 is provided with operation buttons such as a mode switching button 9, a record button 15, and selection buttons 17. The control panel 5 is also provided with an indicator 11, and a display 13.

Figure 3:
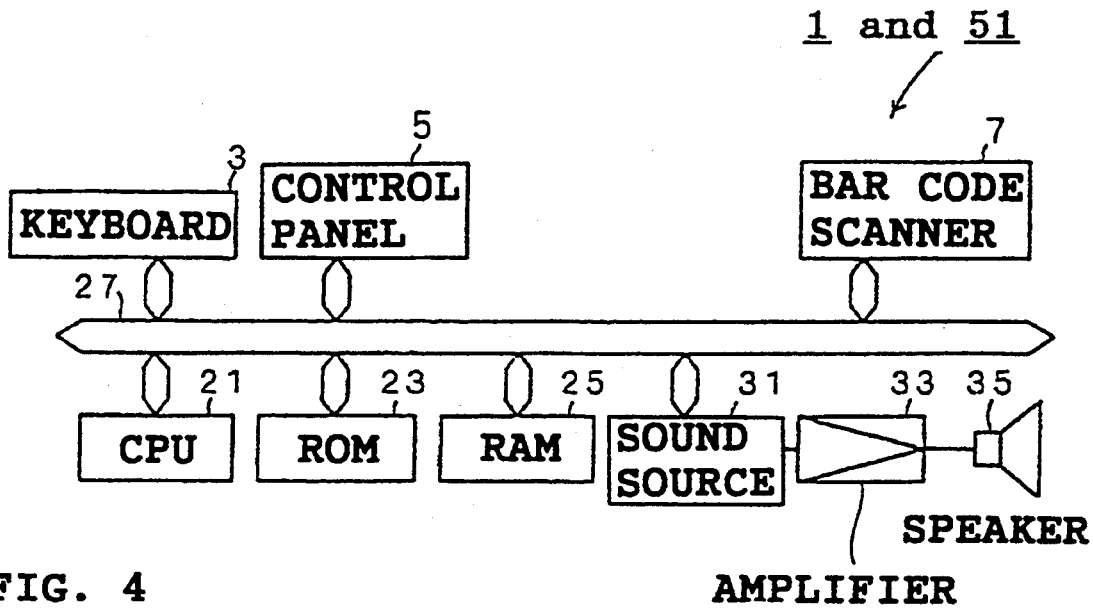
FIG. 3 is a block diagram showing the connection among components of the synthesizer and the electronic organ of the first and second embodiments.

The synthesizer 1 also includes, as shown in FIG. 3, a known CPU 21, ROM 23, and RAM 25 which are interconnected via bus 27 with the bar code scanner 7, control panel 5, and a sound source 31. The sound source 31 is connected to an amplifier 33 and a speaker 35.

The bar code scanner 7 is a known type of scanner wherein a reflected image of an object, which is a bar code in this case, is focused on an image sensor (not shown) to generate electric signals. The electric signals are amplified, converted into two values, and decoded. The bar code scanner 7 may be separate from the main body, such as a pen type scanner for example, which is not installed at the main body.

Figure 5:
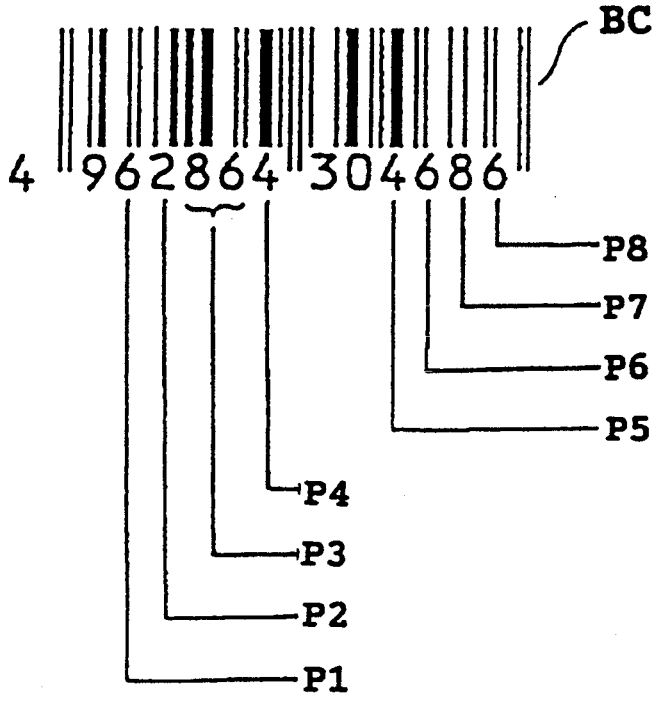
FIG. 5 is a diagram showing which digit of a bar code is assigned to which parameter of sound in the first embodiment.

Attributes of sound, such as volume, pitch, timbre, and stretch of sound, are stored as a plurality of parameters in the ROM 23. In this embodiment, eight parameters are specified as shown in FIG. 5, and controlled respectively when synthesizing a sound.

The first parameter (P1) in this embodiment is the feet pitch of the C ("do") note at the center of the keyboard 3. For example, it is defined that the values of "6" through "9" of the parameter correspond respectively to 8 feet, 4 feet, 2 feet, and 1 feet pitches.

The second parameter (P2) determines sound volume according to the values of "0" through "9". Specifically, the larger the value of this parameter, the louder the sound.

The third parameter (P3) is for timbre of sound. Each of its values "00" through "99" corresponds respectively to a specific sound waveform, which varies as a function of harmonic structure, of a specific instrument among one hundred types of music instruments. For example, the value of "08" specifies the timbre of flute, and the value of "15" selects piano.

The fourth parameter (P4) determines a type of effect. For example, the value of "4" is for vibrato and the value of "5" is for tremolo.

Figure 4:
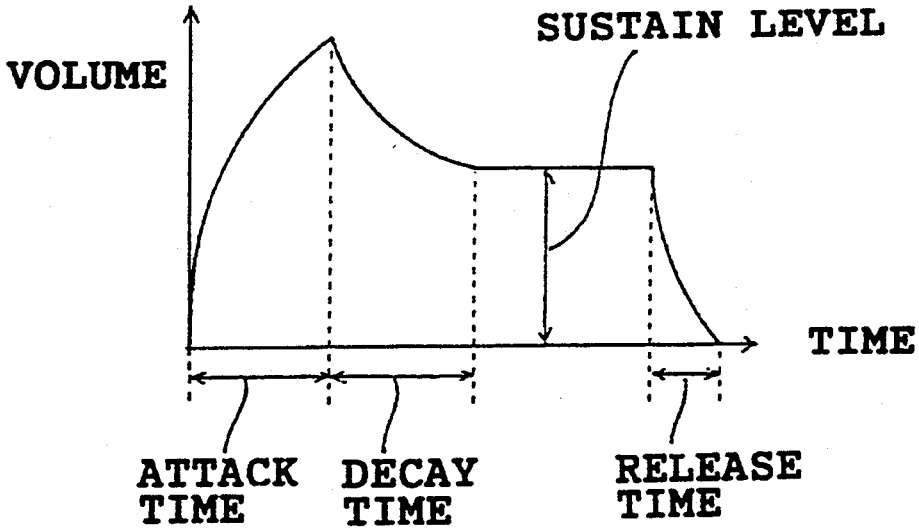
FIG. 4 is a timing chart showing an envelope curve of sound volume referred to in the first embodiment.

The fifth through eighth parameters (P5–P8) provide respectively for an attack time, a decay time, a sustain level, and a release time which are plotted against an envelope curve, shown in FIG. 4, thereby determining stretch or development of a sound. The attack time is the time period from start-up of sound to its reaching the highest level of volume. The larger the value of the fifth parameter, the later the sound becomes the loudest. The decay time is the time period it takes for the sound at the highest level in volume to diminish and come to a stable level of volume. The larger the value of the sixth parameter, the longer the sound takes to come to the stable level. The sustain level is the level of volume at which sound is sustained stable. As the value of the seventh parameter becomes larger, the sound is sustained stable at a higher level of volume. The release time is the time it takes from release of a key 3 to total fade away of sound. The larger the value of the eighth parameter, the longer the sound drags on.

In operation, a mode switching button 9 is first pressed and an arbitrary bar code BC at hand, such as one on a candy bar package, is scanned by the bar code scanner 7. When the bar code BC is successfully scanned, a buzzer (not shown) goes off. When the scanning is not successful, the bar code scanner 7 remains on standby condition.

Since the leftmost two digits of the bar code BC is disregarded in the allocation of parameters as shown in FIG. 5, the third digit from the left "6" corresponds to the first parameter, the fourth digit "2" to the second parameter, the fifth and sixth digits "86" to the third parameter, and the seventh digit "4" to the fourth parameter. In this embodiment, the eighth and ninth digits are skipped. The tenth digit "4" through the thirteenth digit "6" correspond to the fifth through eighth parameter, respectively.

The value "6" of the first parameter determines that the C note at the center of the keyboard 3 is in 8 feet pitch. The volume level is set at "2" according to the second parameter. The timbre of sound is of waveform number "86". The stretch of sound is determined by an envelope curve with the attack time at level of "4", decay time at level of "6", sustain level at level of "8", and release time at level of "6". The sound effect is determined to be vibrato according to the fourth parameter.

Thus, the attributes of sound is controlled and stored according to the parameter data in correspondence with the data included in the bar code BC.

When the mode switching button 9 is pressed again, the synthesizer 1 is on a play mode. Upon depression of a desired key on the keyboard 3, the sound corresponding to the desired key note will be output from the sound source 31 with the attributes determined according to the scanned bar code BC. Therefore, even when the same key is depressed with the same intensity, the pitch, volume, timbre and/or other characteristics of the sound that will be synthesized can be different if a different bar code BC has been scanned.

Thus, selection of values to determine the attributes of sound can be made simply by scanning a bar code BC. Sound with random, unexpected and accidental attributes is attained and may entertain even younger children, who would associate the sound with a pen case, chewing gum, or other item on which the bar code BC is scanned. Four kinds of sound at maximum can be stored by pressing the record button 15 and one of the selection buttons 17 with numerals of "1" through "4" on them. The stored sound can be selected at the selected selection button 17.

[EMBODIMENT 2]

Figure 6A:
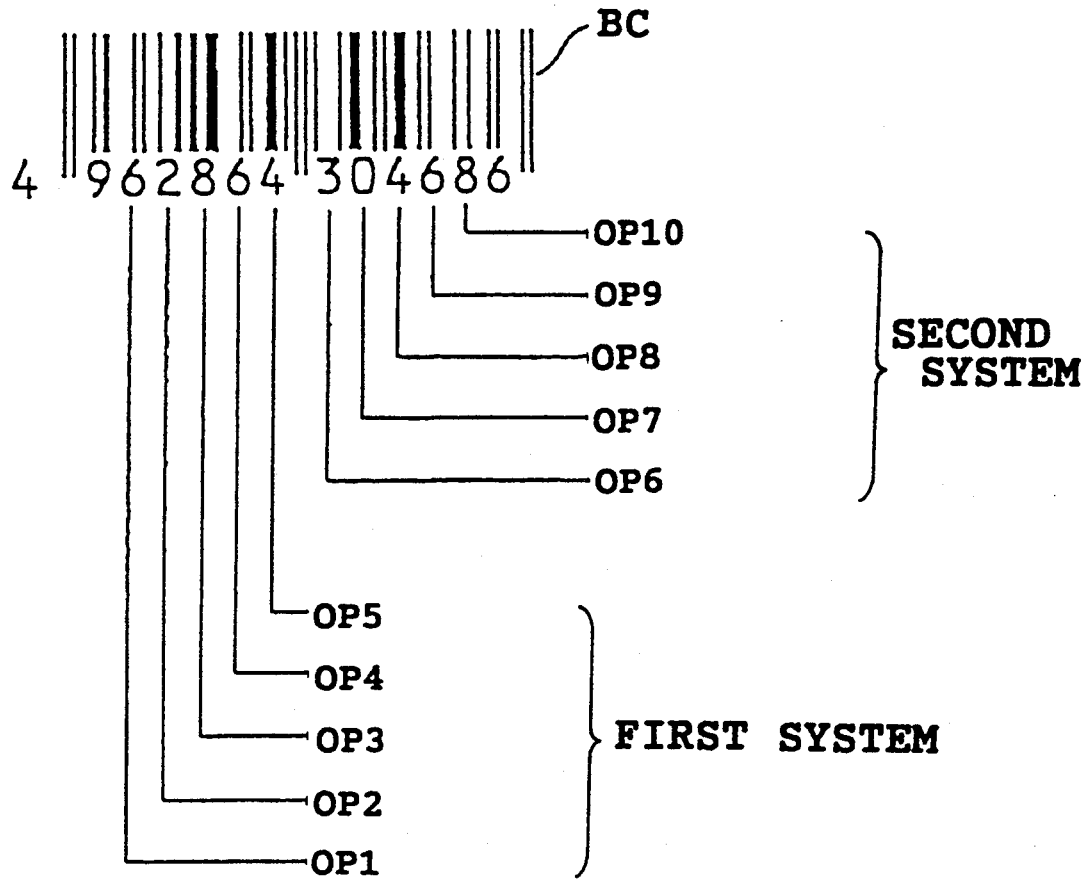
FIG. 6A is a diagram showing which digit of a bar code is assigned to the volume of which feet pitch for an electronic organ in the second embodiment.

In a second embodiment, sound volume for each register of an electronic organ 51 is, as shown in FIG. 6A, the parameter to be controlled according to a bar code BC such that draw bars of the organ 51 change the sound volume for each register. Since an organ 51 has two systems to generate sound, the third through seventh digits from the left of the bar code correspond to the first through fifth parameters, and the eighth through twelfth digits correspond to the sixth through tenth parameters, respectively.

In the instant embodiment, the first through fifth parameters (OP1–OP5) and the sixth through tenth parameters (OP6–OP10) correspond respectively to the first sound generating system and the second sound generating system, thereby controlling the volume of the harmonic generated by sixteen feet, eight feet, four feet, two feet, and one feet of their respective sound generating system.

When a sound is generated with the sound volume of its harmonics determined according to the above described manner, the difference in volume level of these harmonics results in variance in tone of sound.

Specifically, the volume of sixteen feet pitch for the first system is relatively increased by a factor of six according to the first value of "6" of the scanned bar code BC, as shown in FIG. 6A. In the same manner, it is determined that the volume of eight feet pitch is increased by a factor of two, the volume of four feet pitch is increased by a factor of eight, the volume of two feet pitch is increased by a factor of six, and the volume of one feet pitch is increased by a factor of four.

In a sound generating system of such an electronic organ where a sound is electronically synthesized, a desired sound is obtained through the following equation:

$$WAVE(T)=n1\sin(\omega\ T)+n2\sin(\omega\ 2T)+n3\ \sin(\omega\ 4T)+n4\sin(\omega\ 8T)+n5\sin(\omega\ 16T)$$

where: n1=level of sixteen feet (value of bar code)
n2=level of eight feet pitch (value of bar code)
n3=level of four feet pitch (value of bar code)
n4=level of two feet pitch (value of bar code)
n5=level of one feet pitch (value of bar code)

$$\omega:\omega=2\pi\ f$$

$\pi$=ratio of circumference of a circle to its diameter
f=frequency (Hz)
T: time period (T=1/fs fs: sampling frequency)

Figure 6B:
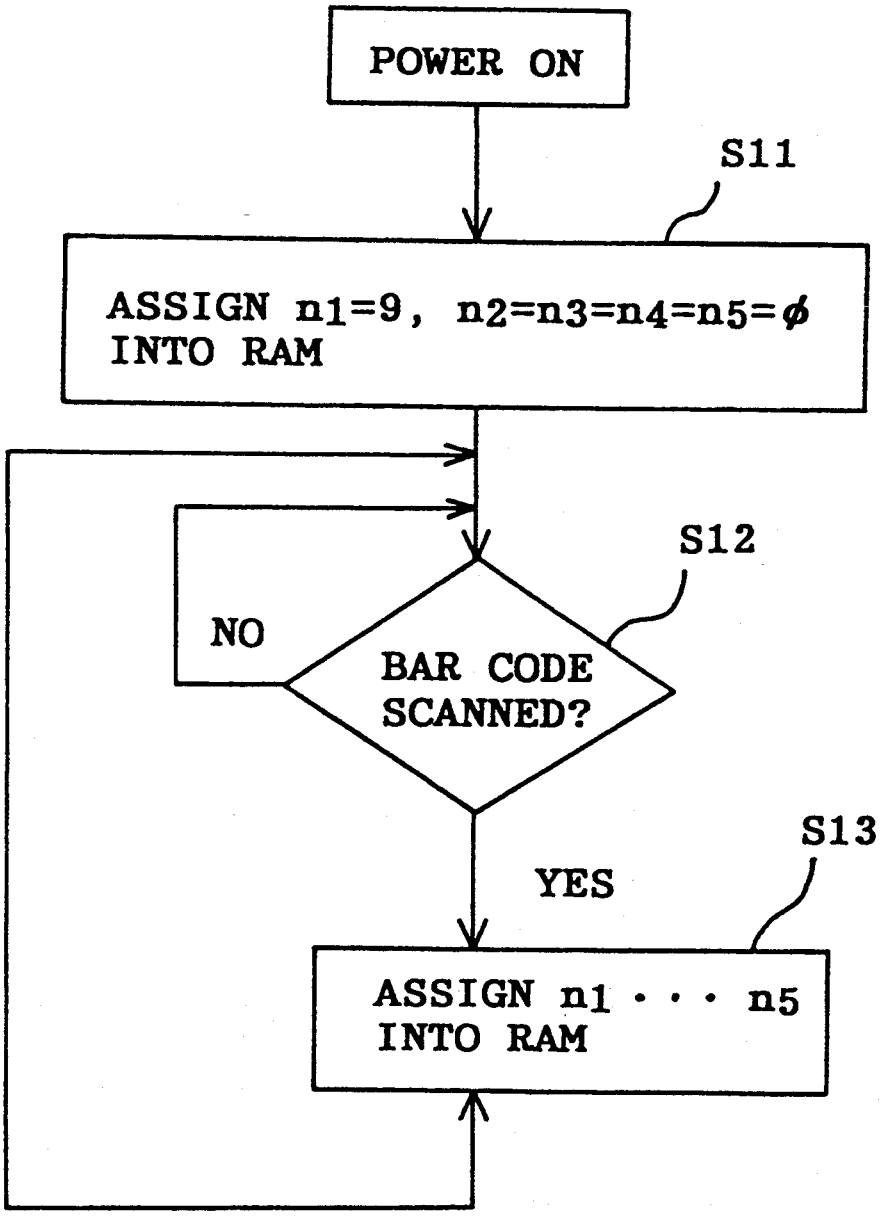
FIGS. 6B and 6C are flowcharts showing how the volume of each feet pitch is controlled in the second embodiment.
Figure 6C:
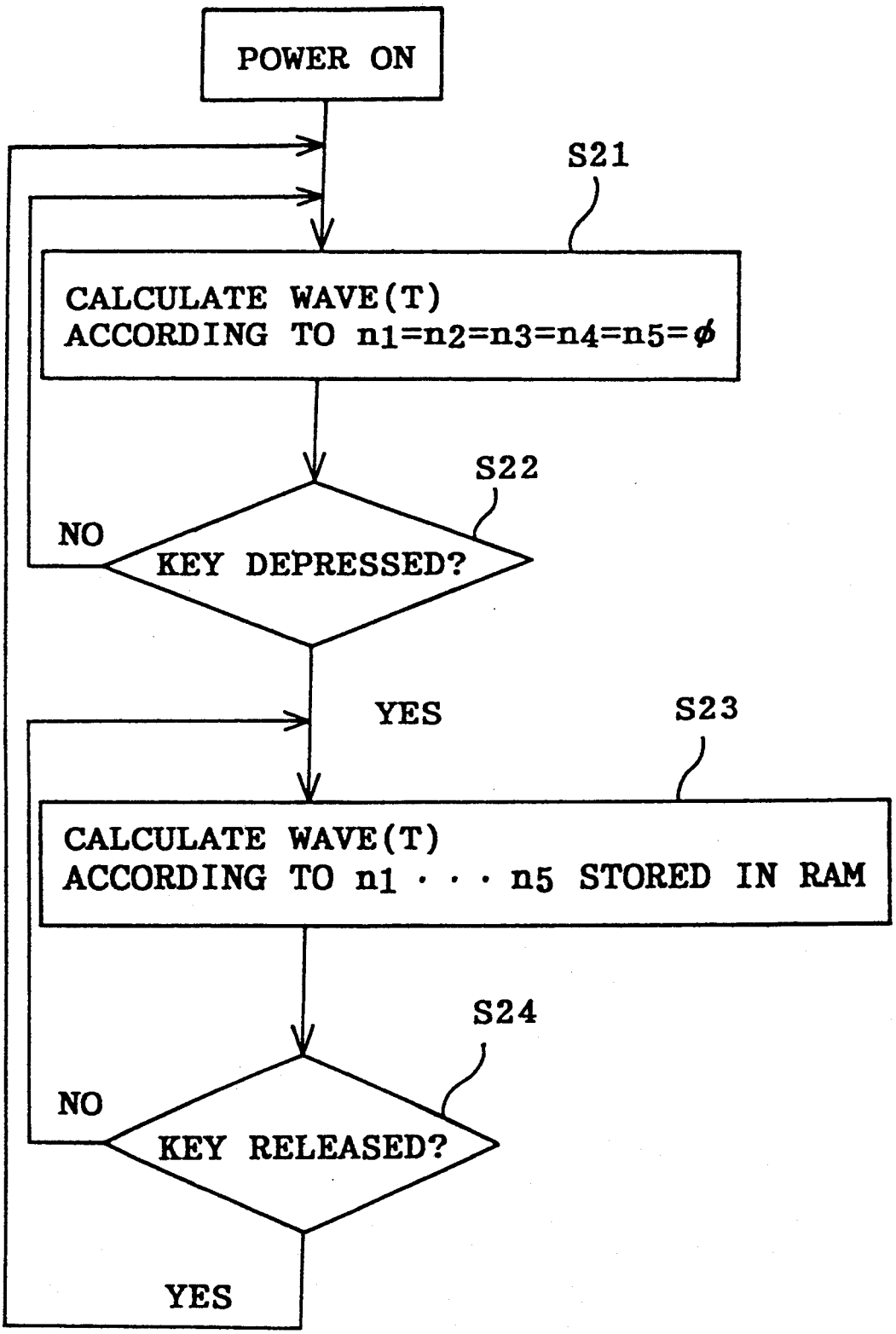

When the electronic organ 51 is turned on, volume determination process steps, shown in FIG. 6B, starts. At the first step S11, only the variable of n1 in RAM 25 is assigned a specific value of "9", while the other variables n2 through n5 are assigned values of "0". The assignment of the integer value of "9" only to the variable of n1 results in sound generation of predetermined note and with a predetermined volume. An operator can thus check the electronic organ 51 for normalcy.

When it is determined at step 12 that a bar code BC is scanned, the process steps proceeds to S13 where control data reflecting the scanned bar code BC is stored into RAM 25 with respect to n1 through n5.

When the mode switching button 9 is pressed, the electronic organ 51 is in a play mode. At step S21, the variables n1 through n5 are assigned values of "0" such that no sound is generated until the keyboard 3 is operated.

When it is determined at step S22 that the keyboard 3 is operated, the process steps proceeds to step S23 where the values of n1 through n5 are read out from the RAM 25, and the above equation is calculated to obtain WAVE(T). Thus a sound, corresponding to the depressed key, is generated having a waveform obtained through the calculation of WAVE(T).

In response to the determination of key release at step S24, the process steps goes back to S21, thereby terminating the sound generation.

Thus, a sound is generated with its harmonics regulated according to the control data obtained from the scanned bar code BC.

[EMBODIMENT 3]

In this embodiment, the present invention is applied to a rhythm machine.

Figure 7:
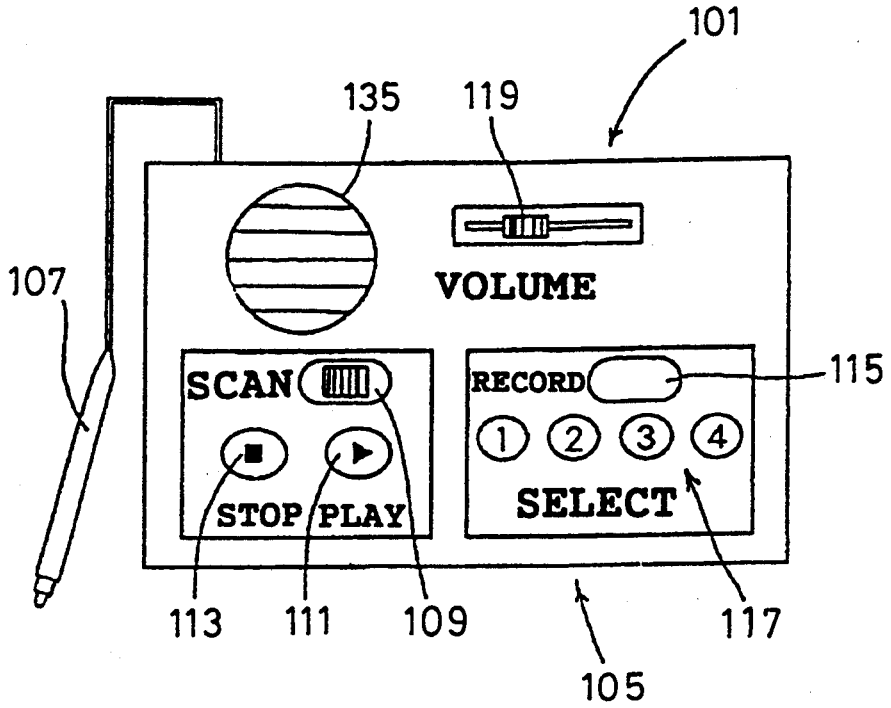
FIG. 7 is a top plan view showing a front panel of the rhythm machine of the third embodiment.
Figure 8:
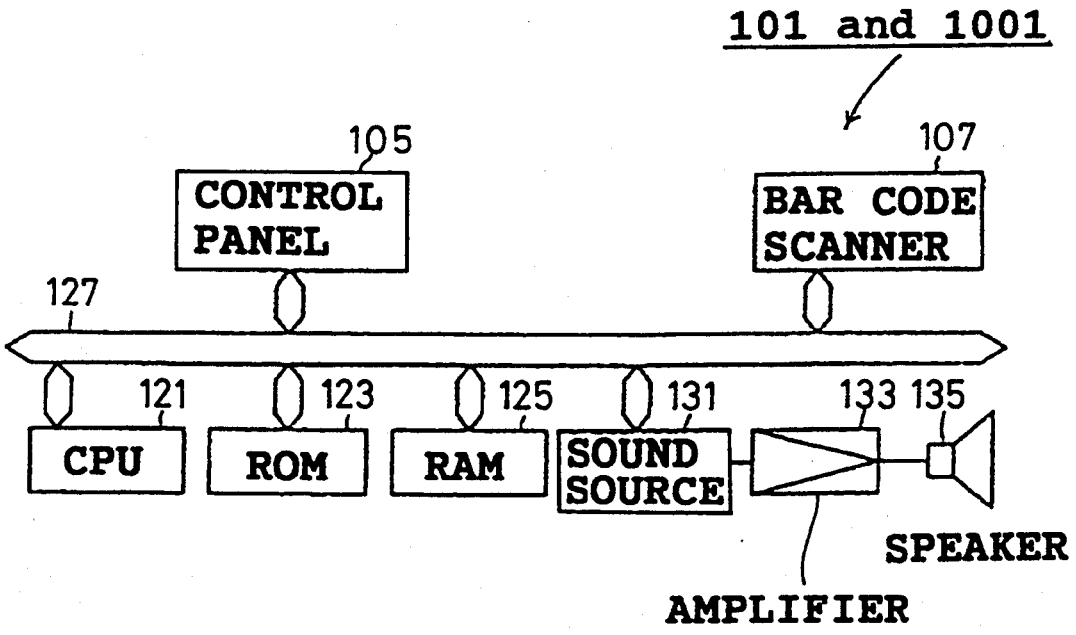
FIG. 8 is a block diagram showing the connection between components of the electronic sound generating apparatus of the third and a fourth embodiments.

As shown in FIG. 7, a rhythm machine 101 is provided with a control panel 105, a pen type bar code scanner 107, and a speaker 135. On the control panel 105, there are provided a scan button 109, a play button 111, a stop button 113, a record button 115, selection buttons 117, and a volume controller 119. As shown in FIG. 8, the rhythm machine 101 has a similar electric construction and connection to that of the synthesizer 1 of the first embodiment, but without the keyboard 5. The pen type bar code scanner 107 functions in the same manner as the bar code scanner 7 of the first embodiment.

A ROM 123 stores ten types of rhythm patterns with respect to ten types of percussion instruments. The type of rhythm pattern is determined by digits having values of "1" through "9" and "0" of a bar code BC that is scanned.

Figure 9:
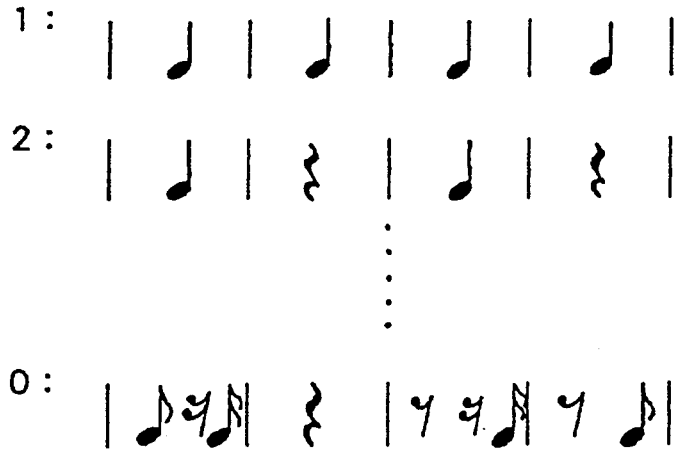
FIG. 9 is a diagram showing rhythm patterns of bass drum in the third embodiment.
Figure 10:
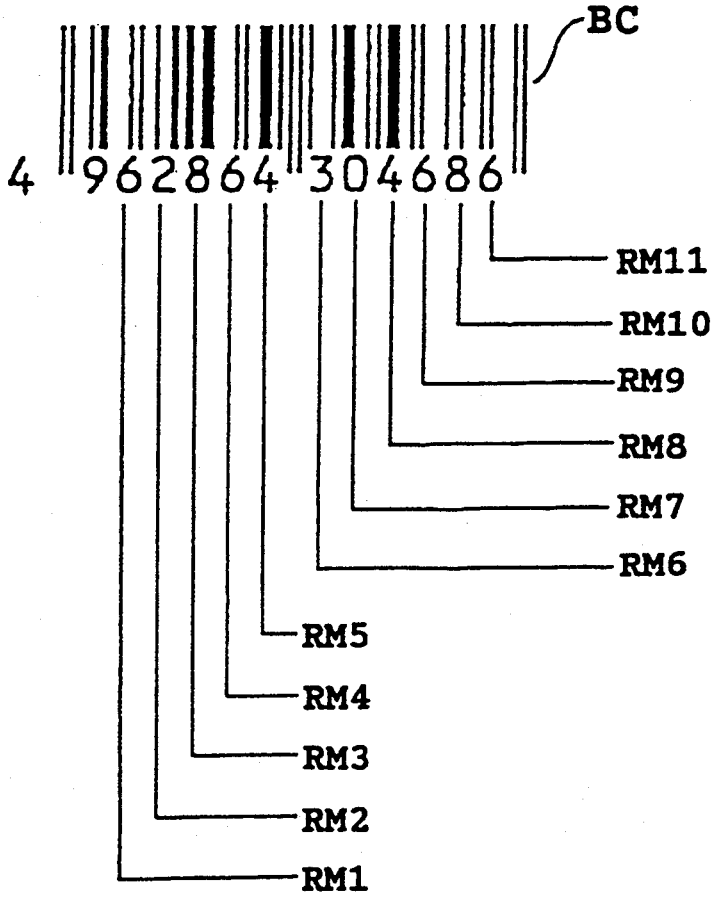
FIG. 10 is a diagram showing which digit of a bar code is assigned to which percussion instrument in the third embodiment.
Figure 11:
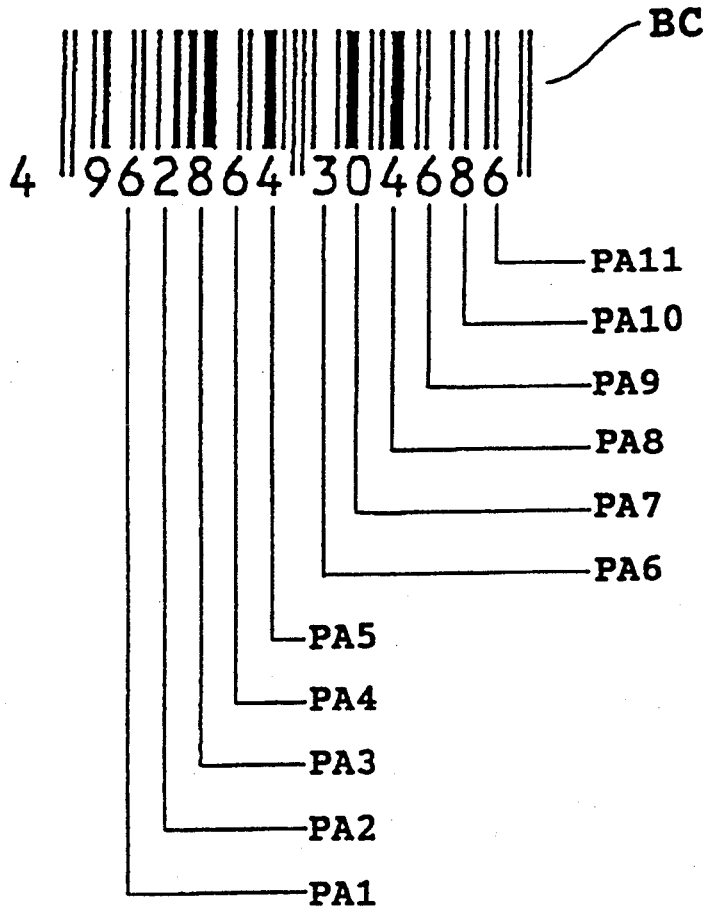
FIG. 11 is a diagram showing which digit of a bar code is assigned to which part of a sheet music in the fourth embodiment.

As shown in FIG. 9 which shows rhythm patterns of bass drum, the smaller in number among the values of "1" through "9" the scanned digit is, the simpler the rhythm pattern. The value of "0" indicates the most complicated rhythm pattern.

In operation, the scan button 109 is pressed and a bar code BC is scanned. When the scan button 109 is pressed again, the scanning is stopped.

For the same reason as in the first embodiment, the leftmost two digits of the bar code BC are omitted in assigning parameters of control data. The third through twelfth digits of the bar code BC (RM1–RM11) are respectively assigned to bass drum, snare drum, low conga, high bongo, rim shot, cymbal, high-hat cymbal, maraco, shaker, and whistle. The thirteenth digit is left unassigned for any other instrument.

The play button 111 is next pressed. Electric signals, according to the type of instrument assigned to the parameters and according to the rhythm pattern selected by the digit of the bar code BC, are output from a sound source 131, and amplified by an amplifier 133, and a corresponding sound is generated at the speaker 135. Therefore, the performance can be varied by scanning different bar codes BC. When the stop button 113 is pressed, the performance is stopped.

If an operator wishes to record the performance, the record button 15 is to be pressed. One of the selection buttons 117 with the numerals of "1" through "4" on them is next pressed, thereby recording the performance according to the numerals of the pressed selection button 117. The performance, once recorded, can be reproduced by pressing the selected selection button 117.

[EMBODIMENT 4]

The present invention is applied in this embodiment to an automatic performing apparatus.

Popular music in general has a standard course of development which can be divided into a plurality of parts, i.e. for example, an introduction, period A, period B, refrain, period A', period B', refrain, bridge, refrain ending, and reserve (PA1–PA11, respectively). Each part consists generally of eight measures.

In this embodiment, a sheet music is divided into the above explained ten parts and the ten parts are assigned to parameters of control data. The ROM 123 stores a plurality of performance patterns with respect to the ten parts of the music. The performance patterns are predetermined in the wide range of music genres such as folk song A, folk song B, rock music A, and rock music B. For example, an introduction led by the performance pattern of the folk song A may include a flute tone, or a bridge led by the folk song B may include guitar tone.

In operation, a bar code BC is scanned by the bar code scanner 107 in the same manner as in the first through third embodiments. According to the value of the bar code data thus scanned, the above explained performance patterns are allocated to each of the ten parts of the music.

Thus it is determined that the introduction of the music is led by rock music A, the period A by folk song A, the period B by popular music B, and so on.

When the play button 111 is pressed, the music is automatically recreated with each part of the music having a selected pattern. The stop button 113 will stop the performance. When an operator wishes to record the performance, the record button 115 and one of the selection buttons 117 with numerals of "1" through "4" are to be pressed. The music is recorded according to the selected numeral of the selection button 117. The recorded music can be recreated by pressing one of the selection buttons 117.

This invention has been described above with reference to preferred embodiments as shown in the drawings. Modifications and alterations may become apparent to one skilled in the art upon reading and understanding the specification. Despite the use of the embodiments for illustration purposes, it is intended to include all such modifications and alterations within the scope and the spirit of the appended claims.

In this spirit, it should also be noted that any determinant of characteristics in sound or music other than those utilized in the embodiments can be assigned to parameters of control data.

A floppy disc or other memory means, separate from the main body, may be utilized to supply data to each parameter thereby providing a wider variety of expression for sound or music.

It may be also possible to set basic values for control data and the data obtained from a bar code BC is added, or its coefficient multiplied to the basic values, thereby converting the control data according to the scanned bar code BC.

Wherefore, having described the present invention, what is claimed is:

1. An electronic sound generating apparatus, for generating sound having a plurality of attributes controlled according to a scanned and decoded arbitrary bar code comprising:

scanning means operable for scanning an arbitrary bar code, said arbitrary bar code representing a plurality of arbitrary bar code encoded digits, and said scanning means providing a plurality of decoded digits corresponding to said plurality of said arbitrary bar code encoded digits;

memory means for storing a plurality of sound attribute control data groups, each sound attribute control data group including a data element for controlling an attribute of a sound to be generated;

sound attribute selection means, coupled to said memory means and responsive to said decoded digits received from said scanning means, for selecting a data element from a sound attribute control data group according to a decoded digit from said plurality of decoded digits of said scanned arbitrary bar code, and for providing that selected data element to control a sound attribute; and, sound generating means, responsive to each said selected data element provided by said sound attribute selection means, for generating sound having said sound attributes determined by said scanned arbitrary bar code.

2. The apparatus of claim 1, wherein each of said sound attribute control data groups includes a plurality of data elements.

3. The apparatus of claim 2, wherein said sound attribute selection means selects and provides sound attribute control data group data element for each of a plurality of selected ones of said decoded digits of said scanned arbitrary bar code.

4. The apparatus of claim 2, wherein said sound attribute selection means selects and provides at least one sound attribute control data group data element according to two predetermined decoded digits of said scanned arbitrary bar code.

5. The apparatus of claim 1, wherein said sound attribute selection means ignores at least one decoded digit received form said scanning means.

6. An electronic sound generating apparatus, for generating sound having a plurality of attributes controlled according to a scanned and decoded arbitrary bar code comprising:

scanning means operable for scanning an arbitrary bar code, said arbitrary bar code representing a plurality of arbitrary bar code encoded digits, and said scanning means providing a plurality of decoded digits corresponding to said plurality of arbitrary bar code encoded digits;

memory means for storing a plurality of sound attribute control data groups, each sound attribute control data group including a plurality of data elements, each data element in a respective one of said sound attribute control data groups controlling one attribute of the sound to be generated;

sound attribute selection means, coupled to said memory means and responsive to said decoded digits received from said scanning means, for selecting data elements from said plurality of said sound attribute control data groups according to a plurality of decoded digits of said scanned arbitrary bar code, and for providing said plurality of selected data elements to control a plurality of sound attributes; and sound generating means, responsive to said plurality of selected data elements provided by said sound attribute selection means, for generating sound having sound attributes determined by said scanned arbitrary bar code.

7. The apparatus of claim 6, wherein said sound attribute selection means ignores at least one decoded digit received from said scanning means.

8. The apparatus according to claim 6 wherein said data elements stored in said memory means includes data relating to at least sound volume, sound timbre and a sound envelope curve of a sound to be generated, and said sound attributes selection means selects at least the sound volume, the sound timbre and the sound envelope curve from said memory means in response to said decoded digits received from said scanning means.

9. The apparatus according to claim 8 wherein said data elements stored in said memory means, relating to said sound envelope curve, further includes data relating to an attack time, a decay time, a sustained level time and a release time of the sound to be generated by said sound generation means.

10. The apparatus according to claim 6, in combination with an electronic organ having a first register and second register, wherein said data elements stored in said memory means includes data relating to at least a sound volume for the first register and for the second register of the electronic organ of a sound to be generated, and said sound attributes selection means selects at least the sound volume for the first register and for the second register of the electronic organ from said memory means in response to said decoded digits received from said scanning means.

11. The apparatus according to claim 6 wherein said data elements stored in said memory means includes data relating to at least percussion attributes of a sound to be generated, and said sound attributes selection means selects at least the percussion attributes from said memory means in response to said decoded digits received from said scanning means.

12. The apparatus according to claim 11 wherein said data elements stored in said memory means, relating to said percussion attributes, further includes data relating to a base drum parameter, a snare drum parameter, a low conga parameter, a high bongo parameter, a rim shot parameter, a cymbal parameter, a high-hat cymbal parameter, a maraco parameter, a shaker parameter and a whistle parameter of the sound to be generated by said sound generation means.

13. The apparatus according to claim 6 wherein said data elements stored in said memory means includes data relating to at least performance patterns of a sound to be generated, and said sound attributes selection means selects at least the performance patterns from said memory means in response to said decoded digits received from said scanning means.

14. The apparatus according to claim 11 wherein said data elements stored in said memory means, relating to said performance patterns, further includes data relating to an introduction portion, a period A portion, a period B portion, a refrain portion, a period A′ portion, a period B′ portion, a refrain portion, a bridge portion, a refrain portion and an ending portion of the sound to be generated by said sound generation means.

15. The apparatus according to claim 14 wherein the data relating to each portion of data consists of 8 measures.

16. The apparatus according to claim 6 wherein said sound attribute selection means selects, in response to each received said scanned arbitrary bar code, at least eight data elements from the plurality of said sound attribute control data groups and provides said selected data elements to said sound generating means to control a plurality of sound attributes of the sound to be generated.

* * * * *